United States Patent [19]

Panzica

[11] Patent Number: 4,913,855

[45] Date of Patent: Apr. 3, 1990

[54] CARBURETOR USABLE WITH MOTORCYCLE ENGINE

[75] Inventor: Ignatius J. Panzica, Morgan Hill, Calif.

[73] Assignee: Custom Chrome, Inc., Morgan Hill, Calif.

[21] Appl. No.: 161,751

[22] Filed: Feb. 29, 1988

[51] Int. Cl.[4] ..... F02M 19/06

[52] U.S. Cl. ..... 261/50.1; 261/72.1; 261/DIG. 8; 261/DIG. 57; 285/91; 123/187.5 R

[58] Field of Search ..... 261/DIG. 57, DIG. 8, 261/39.5, 72.1, 50.1; 285/91, 185; 123/187.5 R

[56] References Cited

U.S. PATENT DOCUMENTS

| | | | |
|---|---|---|---|
| 1,093,258 | 4/1914 | Elster | 285/185 |
| 1,699,324 | 1/1929 | Bracke | 261/DIG. 8 |
| 2,444,459 | 7/1948 | Macpherson et al. | 285/91 |
| 2,786,659 | 3/1957 | Mennesson | 261/39.5 |
| 3,249,345 | 5/1966 | Gast | 261/39.5 |
| 3,736,986 | 6/1973 | Magdars | 285/185 |
| 4,003,968 | 1/1977 | Rickert | 261/DIG. 57 |
| 4,055,609 | 10/1977 | Phelps | 261/DIG. 57 |
| 4,191,716 | 3/1980 | Yamashita et al. | 261/39.5 |
| 4,254,064 | 3/1981 | Bernauer et al. | 261/72.1 |
| 4,350,124 | 9/1982 | Kitano et al. | 261/72.1 |

*Primary Examiner*—Tim Miles

*Attorney, Agent, or Firm*—William W. Haefliger

[57] ABSTRACT

A motorcycle engine carburetor has an easily removable and replaceable venturi tube, an easily removable fuel jet tube, a swiveled fuel inlet fitting, an easily adjustable and downwardly accessible and rotatable starting carburetor accessible air jets, together with additional structural improvements.

16 Claims, 9 Drawing Sheets

(CHOKED)

(UNCHOKED)

CARBURETOR USABLE WITH MOTORCYCLE ENGINE

BACKGROUND OF THE INVENTION

This invention relates generally to carburetors, and more particularly to a simple, rugged, easily adjustable carburetor useful on motorcycle engines.

There is need for improved carburetors as referred to above and characterized by:

(a) ease of removal and replacement of air passage venturis, so that the air intake capacities of motorcycle carburetors may be easily changed;

(b) ease of manual adjustment of a motorcycle carburetor, when the latter is mounted to the side of the engine or manifold, below the rider;

(c) ease of attachment of fuel hoses to motorcycle carburetor; so as to accommodate different hose positions;

(d) simple and effective control of idle conditions.

SUMMARY OF THE INVENTION

It is a major object of the invention to provide carburetor apparatus serving and meeting the above requirements. Basically, the motorcycle carburetor of the invention comprises:

(a) a body forming an axial through passage for intake air, and a butterfly valve in said passage, (b) a venturi tube removably fitting axially endwise in said passage, the tube having an inner wall defining a venturi for passing the air, the tube having a side port, (c) a fuel jet tube carried by the body and projecting laterally through said side port into the venturi for jetting fuel into air passing through the venturi, and for locking the venturi tube in position in said passage, (d) and means associated with the fuel jet tube for effecting lateral withdrawal of the fuel jet tube from the venturi tube and said port therein, thereby enabling removal and replacement of venturi tube, axially endwise from and into said passage.

As will be seen, a fuel float tank is associated with the carburetor body and in communication with the fuel jet tube, and a removable plug carried by the tank is located in alignment with the fuel jet tube to enable access to that tube for effecting fuel jet changes, for engine tuning. After the fuel jet tube and the fuel jet are withdrawn, the venturi tube may be quickly withdrawn endwise away from a stop shoulder in the body air passage that normally seats the venturi tube in locked-in position. The carburetor is typically attached to the side of a motorcycle engine intake manifold, the starting carburetor having a handle presented upwardly for direct grasping by the hand of the cylinder.

Further, the fuel inlet fitting is provided on the carburetor body to project exteriorly thereof for receiving the end of a fuel delivery line, that fitting forming a duct in communication with said tank, with swivel means mounting said fitting to the body to swivel relative to the body. The fitting typically includes a sleeve and a nipple on the sleeve connectible to the fuel delivery line, and said swivel means includes a fastener threadably attached to the body, and forming a swivel bearing for said sleeve.

Also provided is a starting carburetor mounted on the body and a handle for the choke valve for rotating the valve between closed and fully open position, and an auxiliary port into said passage, and air and fuel porting in and associated with the choke valve for gradually reducing air and fuel flow to said auxiliary port such that the fuel flow is cut off before the air flow is cut off, as the valve is rotated from open to closed position. As will be seen, the starting carburetor advantageously includes a rotatable element having air and fuel flow passages therein that are registrable with air and fuel passages in the body and at passage mouths, certain passage mouths enlarged relative to other passage mouths to effect said relationship of air and fuel cut offs.

Finally, the air jets are protectd by a cover on the body, as will be seen.

These and other objects and advantages of the invention, as well as the details of an illustrative embodiment, will be more fully understood from the following specification and drawings, in which:

DRAWING DESCRIPTION

DETAILED DESCRIPTION

Figure 1:
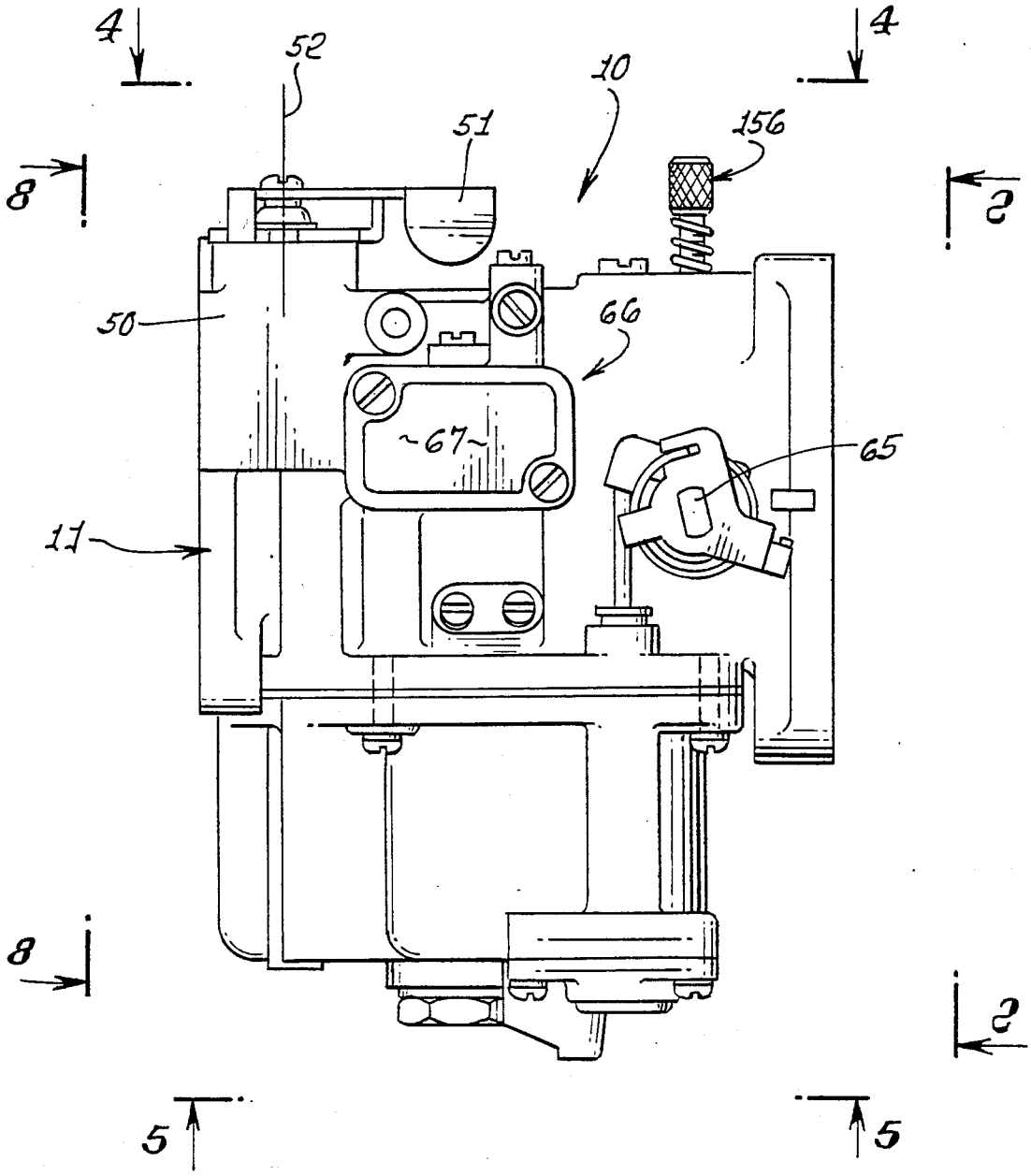
FIG. 1 is a front side elevation of the carburetor of the invention.
Figure 2:
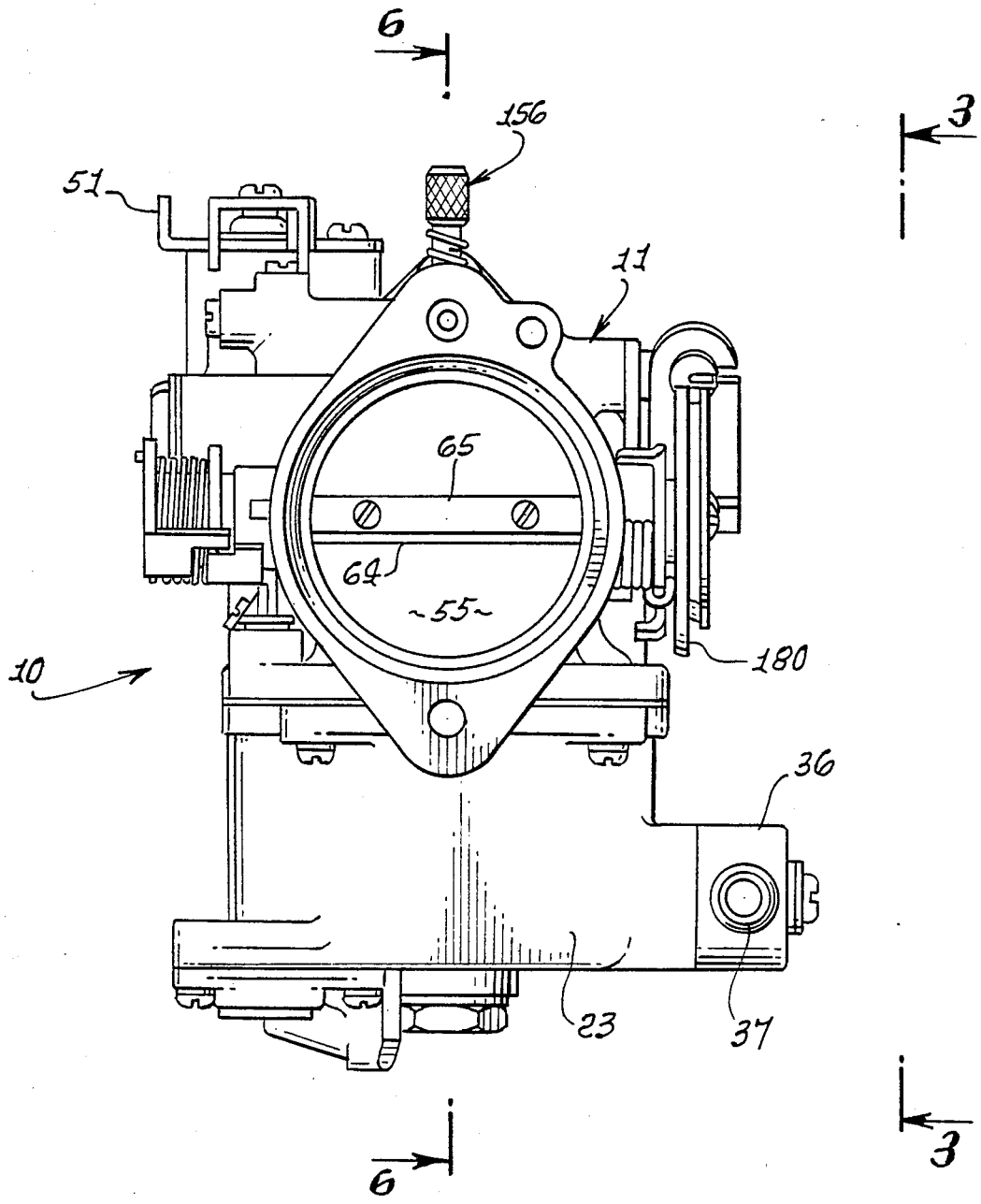
FIG. 2 is a right end elevation on lines 2—2 of FIG. 1.

In the drawings, the carburetor 10 has a body 11 that forms an axially extending annular bore 12, and counterbore 13, with an annular stop shoulder 14 therebetween. A venturi tube 15 fits axially endwise in the bore and counterbore, so that it may be easily removed whenever desired. Step shoulder 16 on the tube tube has a venturi surface 17, as shown, an annular surface 18 fitting in bore 12, and an annular surface 19 fitting in counterbore 13.

Figure 6:
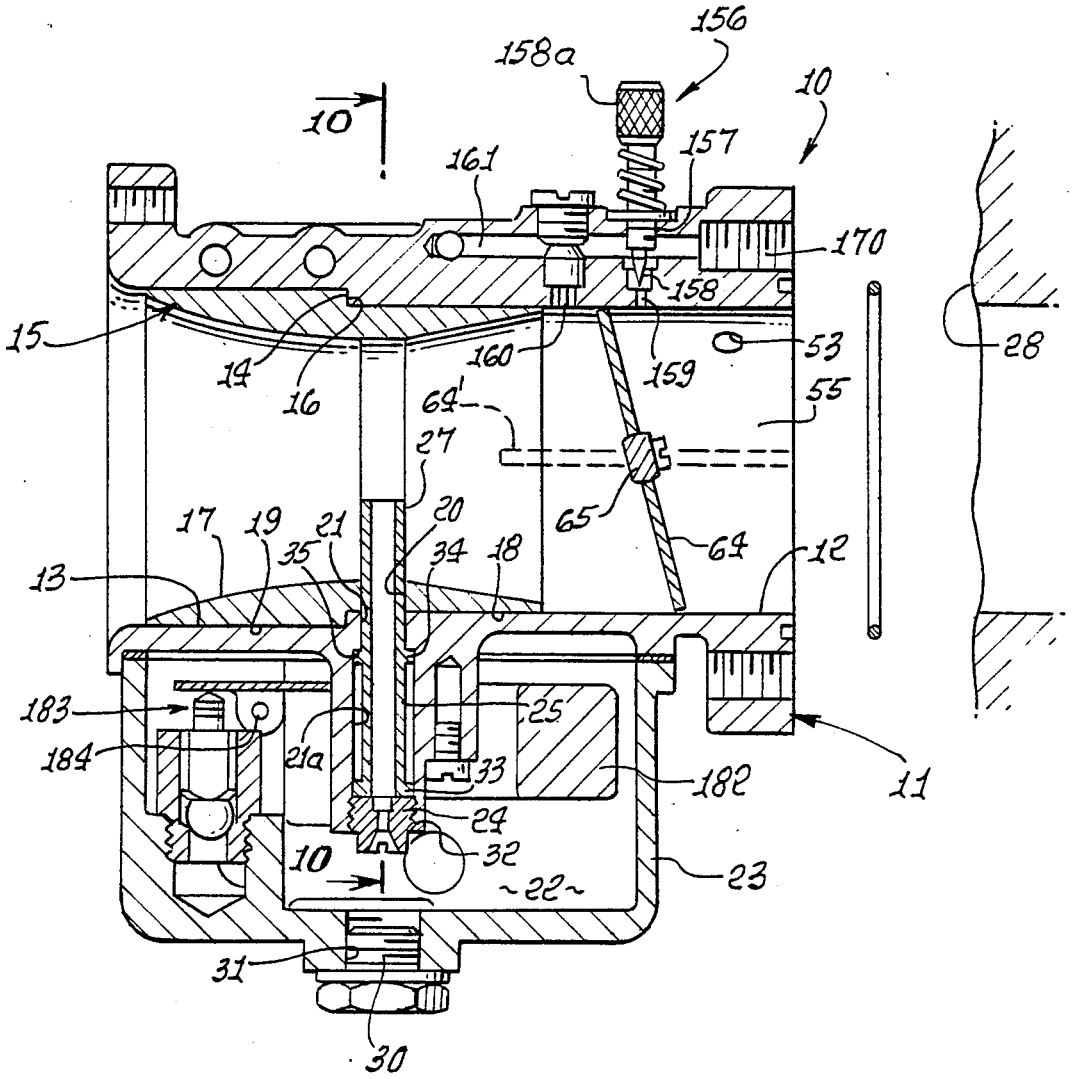
FIG. 6 is a section on lines 6—6 of FIG. 2.

As seen in FIG. 6, the tube also defines a side opening 20 intersecting the surface 17 at the narrowest region of the tube bore. Opening 20 registers with a side opening 21 in body 11. Opening 21 has an enlarged diameter elongated extent **21*a* that terminates at the interior 22 of a fuel float tank 23 attached to the side body 11. Note float 182 controling fuel inlet valve 183, and pivoted at 184. An orifice plug 24 is threaded into the mouth of the enlarged extent 21*a* of the opening 21, for metering fuel to a jet tube 25 which fits in openings 20 and 21 as shown. Tube 25 also extends through and fits the side opening 20 in venturi tube 15, and projects into the venturi tube bore at 27**, whereby fuel is jetted, by aspiration, into the air flowing through the venturi tube, to the engine manifold and to the combustion chamber via intake valving. The latter are schematically indicated at 28.

Figure 8:
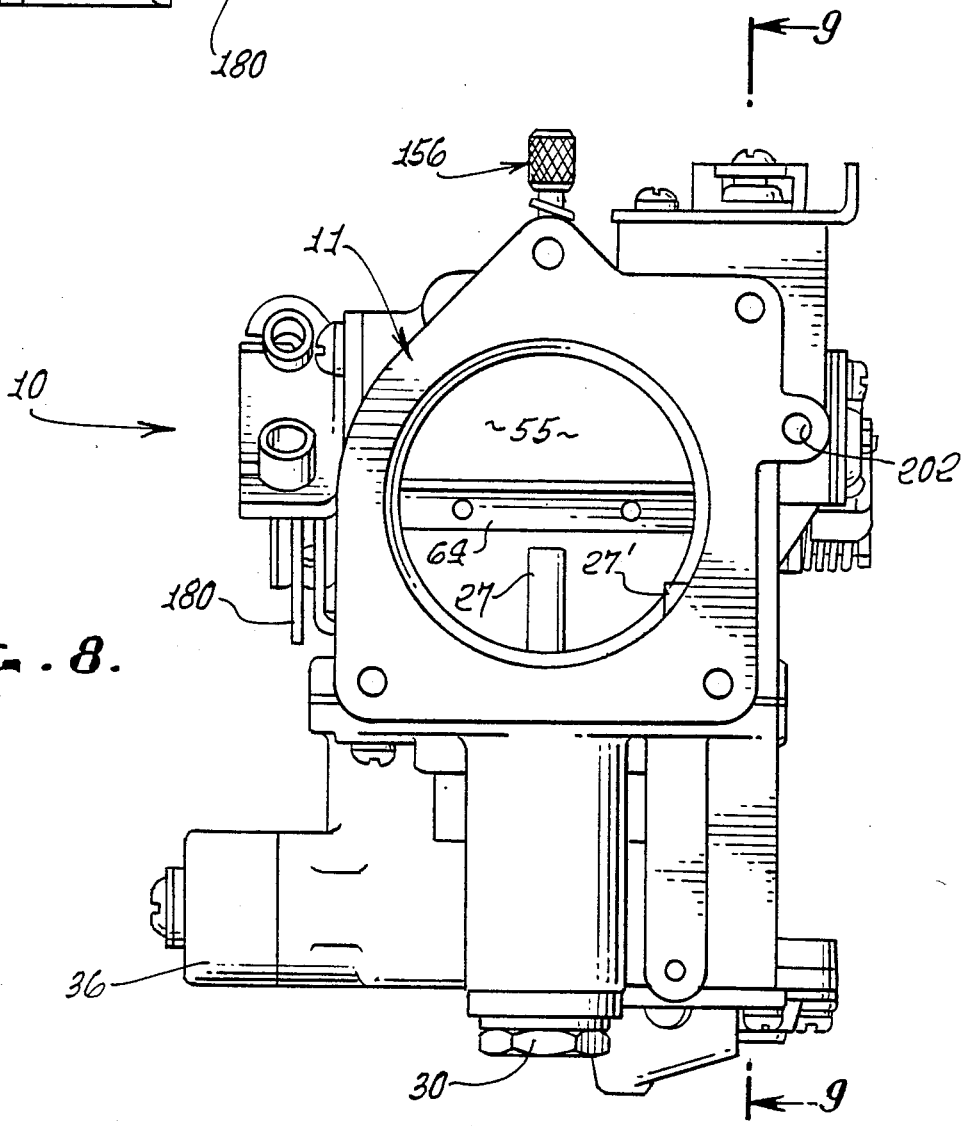
FIG. 8 is a left end elevation taken on lines 8—8 of FIG. 1.

A removable plug 30 is carried by the fuel float tank 23 in a port 31 in alignment with orifice plug 24. After plug 30 is unthreaded from port 31, the orifice plug 24 can be quickly accessed and rotated for removal from its threaded connection 32 to the body 11, and removed via opening 31, after which jet tube 25 can be withdrawn endwise. Orifice plug (i.e. jet) 24 is replaceable for engine tuning. After tube 25 (including its end 27) is withdrawn, and the float bowl (including a part 27' seen in FIG. 8) is removed, the venturi 15 can then be removed leftwardly in FIG. 6. A new and/or different size venturi tube can then be inserted and retained. Note flanges 33 and 34 on tube 25 which rest against plug 24 and against body stop shoulder 35, in installed position.

Figure 3:
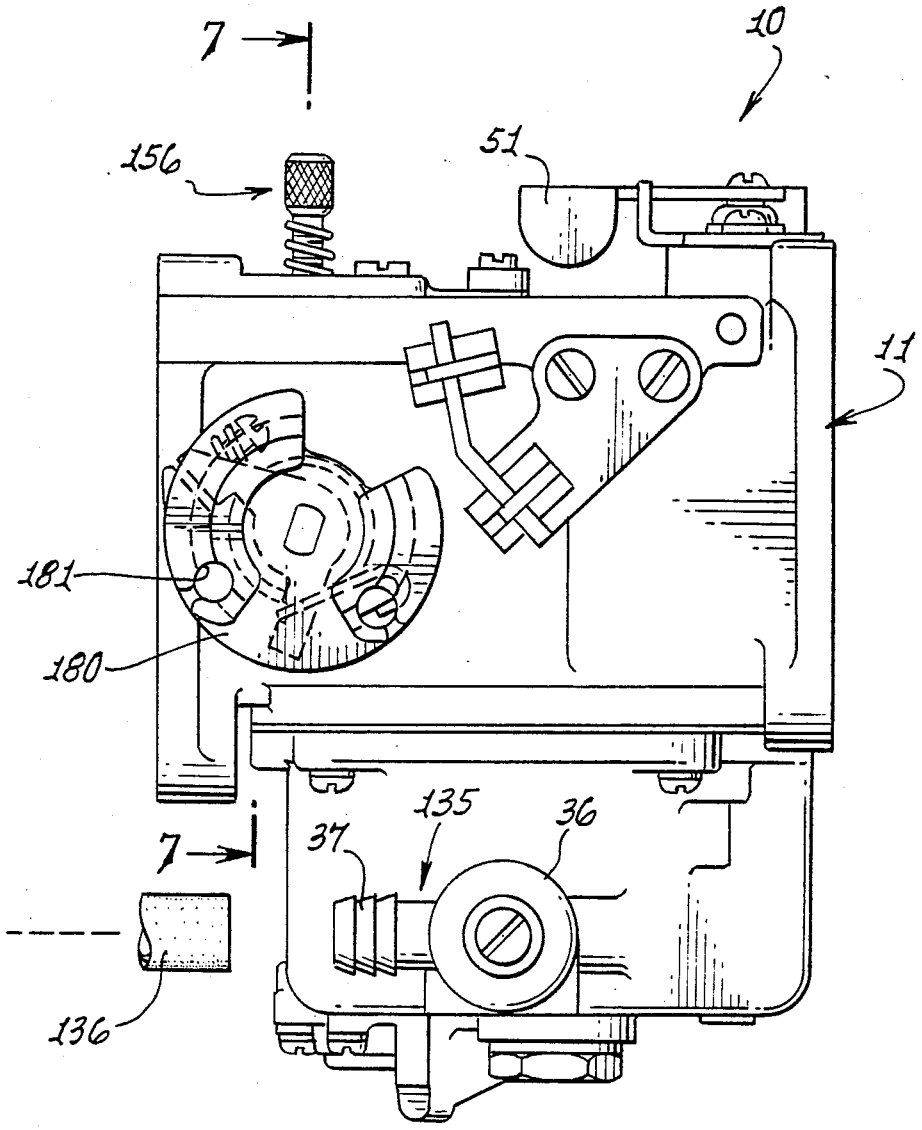
FIG. 3 is a rear side elevation on lines 3—3 of FIG. 2.
Figure 4:
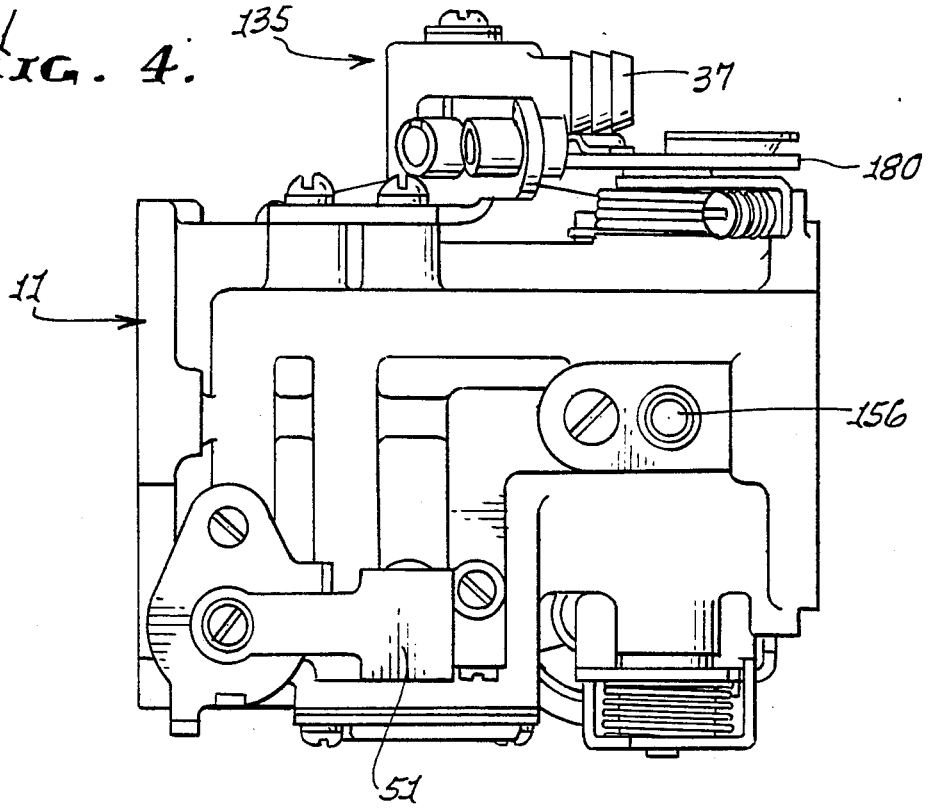
FIG. 4 is a top plan view on lines 4—4 of FIG. 1.
Figure 5:
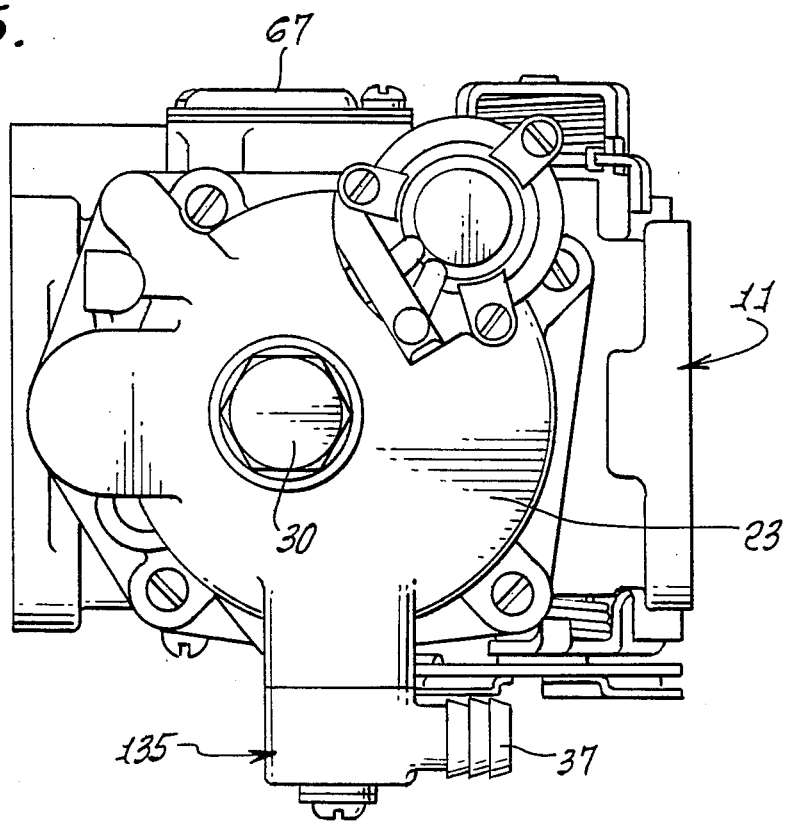
FIG. 5 is a bottom plan view on lines 5—5 of FIG. 1.
Figure 11:
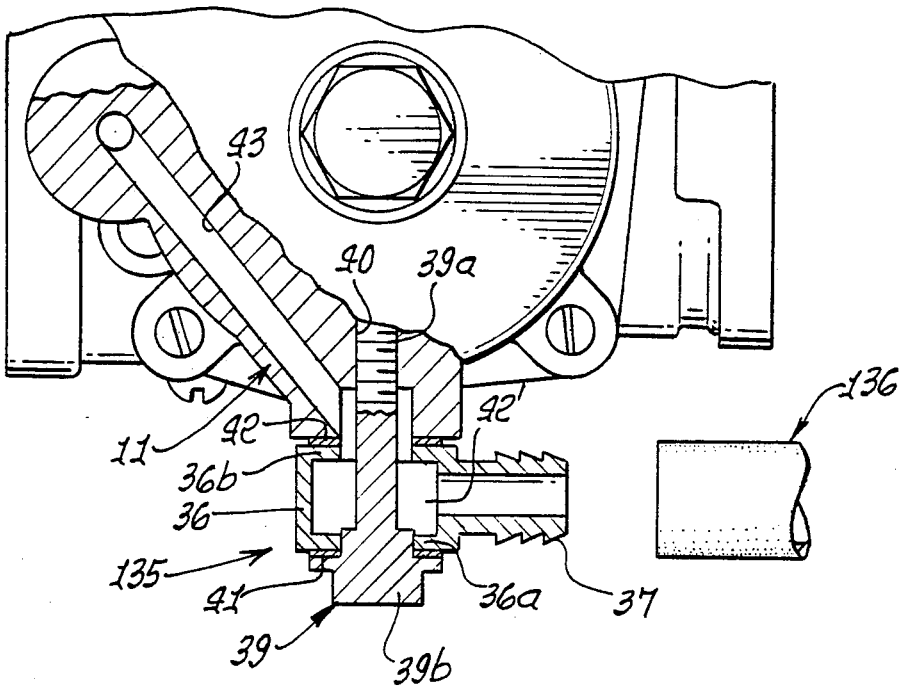
FIG. 11 is a fragmentary section showing a swivel mounted hose fitting.
Figure 16:
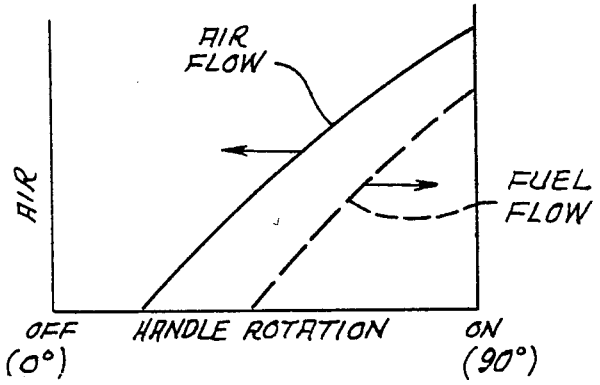
FIG. 16 is a graph.

Also provided, is a fuel inlet fitting 135 on the body 11, and projecting exteriorly for receiving the end 136 of a fuel delivery line, as seen in FIGS. 3 and 11. The fitting includes a sleeve 36 and a serrated nipple 37 on the sleeve, connectible to the fuel delivery line or hose 136. Swivel means for the sleeve includes a bolt type fastener 39 having a threaded end 39*a* adjustably thread connected at 40 to the body 11. A head 39*b* on the fastener clamps the sleeve at a selected angle of swivel of the sleeve about the bolt axis whereby the fitting 135 accomodates to the line 136 at any angle of its approach to the fitting about the axis of the bolt. Flat, annular washer type seals extend at 41 between head 39*b* and sleeve flange 36*a*, and at 42 between sleeve flange 36*b* and the body. Fuel is delivered to the plenum space 42' within the sleeve, then to passage 43 in the body and to the fuel float tank referred to. The fitting 35 may be characterized as a banjo type, barbed, hose fitting.

Referring now to FIGS. 1, 2, 9 and 12–15, a starting carburetor 50 is mounted to the body 11, and a handle 51 for the starting carburetor is rotatable between fully closed and fully open positions. The handle is at the top of the body, and rotates about a vertical axis 52, for ease of access and operation by the motorcyclist, who is seated generally above the carburetor; the latter is connected to one side of the engine. Air and fuel porting is provided in and is associated with the starting carburetor for gradually reducing air and fuel flow to an auxiliary port 153 at the side of the passage 55 surrounded by bore 12, as seen in FIG. 6. The porting is such that the fuel flow is cut off before the air flow is cut off, as a flow control member is rotated from open to close positions. Also, as the flow control member is rotated from closed to open positons air flow is established first (to port 53) by the member, before fuel flow commences. This ensures desired fuel distribution in air, i.e. a rich fuel/air mixture flow to port 53, and also ensures air sweep-out of all fuel in the line to port 53.

Figure 12:
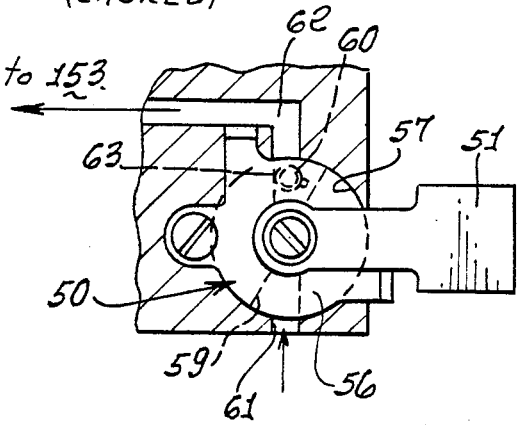
FIGS. 12-14 are fragmentary sections showing choked, partially choked and fully choked positions of a choke valve.

As shown, the member includes a rotor or diverter element 56 mounted for rotation in a circular bore 57 to establish gap 58 therebetween. A passage 59, sidewardly through the rotor, is adapted to pass air, and a fuel duct or passage 60 in the rotor intersects the passage 59 to feed i.e. aspirate fuel such as gasoline to the passage 59 when air flows throught the latter. In FIG. 12, passage 59 is in registration with air passages 61 and 62 in the body 11 to pass air to the port 53; and passage 60 is in registration with fuel supply passge 63, whereby fuel is aspirated to passage 59 for mixing with air and flow to port 53. This is the "choked" position—i.e. the operator desires to feed a rich air/fuel mixture to the port 53 during start of the engine. Spring 190 urges rotor 56 down on surface 191.

Figure 13:
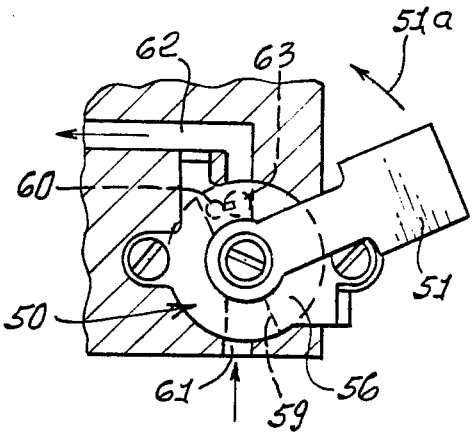
Figure 14:
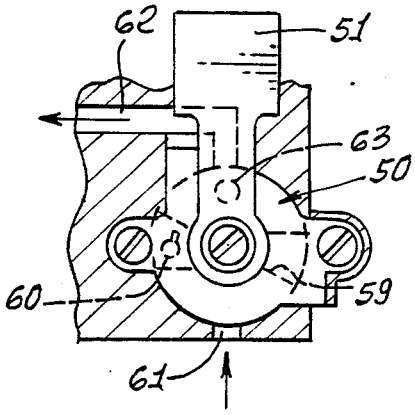

In FIG. 13, the handle 51 has been partially rotated in direction 51*a* so that fuel passage 60 is no longer in registration with fuel and supply passage 63, whereas widened mouth air passage 69 is still in registration with body passages 61 and 62, whereby only air flows to port 53. In FIG. 14, the handle has been rotated a full 90°, to cut off both air and fuel flow to port 53 (i.e. unchoked position).

Figure 15:
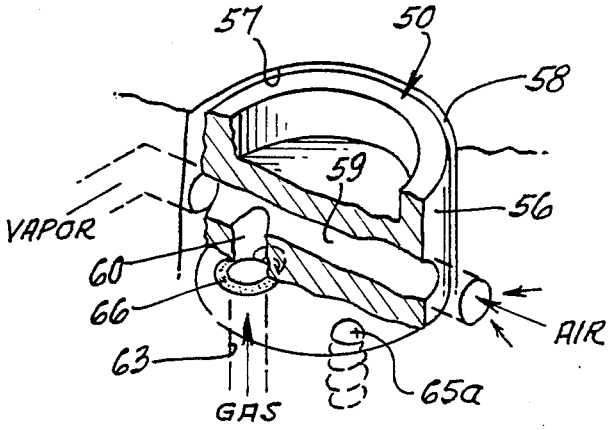
FIG. 15 is a perspective view of the FIG. 12-14 choke valve, partially broken away to show detailed construction.

FIG. 15 shows provision of a spring urged detent 65*a* in the body 11 to engage a depression in the under-side of rotor 56 and and hold it in a selected (such as unchoked) position. Note also seal 66 covered by the rotor about the mouth of passage 60.

Graph 16 shows the relationship of air and fuel flow, to handle 51 position. As seen, the porting is such that, as the element 56 is rotated from open to closed positions, air and fuel flow to the auxiliary port 153 is gradually reduced, and fuel flow being cut off before the air flow is cut off. As described, certain passage mouths are enlarged relative to the passage mouths to effect the described relationships of air to fuel cut-offs.

Figure 7:
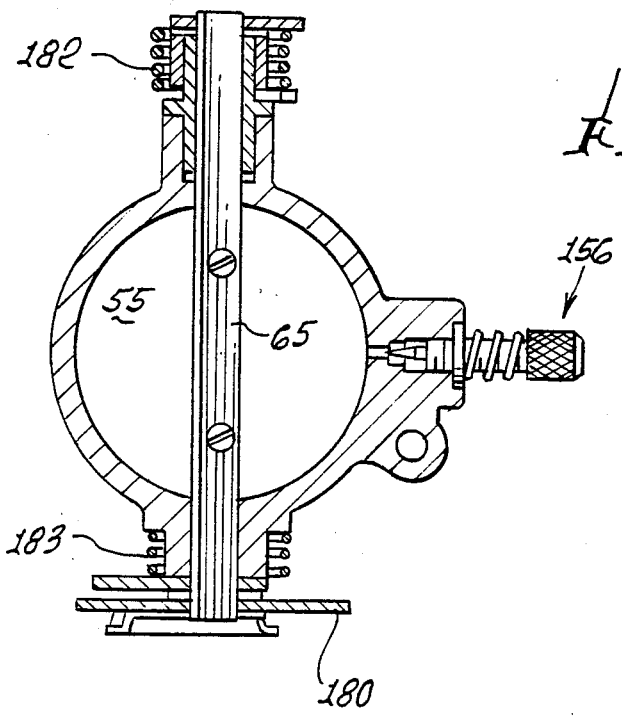
FIG. 7 is a section taken on lines 7—7 of FIG. 3.

A needle valve unit 156 is also provided in the body 11, to control the delivery of air to an auxiliary port 159, as seen in FIG. 6. Its stem 157 is threaded to the body so that needle 158 projects into close proximity to port 159, whereby as the knob 158*a* on the stem is rotated, the amount of air delivered to passage 55 is controlled by the needle. Note air flow passage 161 to port 159. Port 160 to passage 55 is not controlled, so that air flow to that port via passage 161 is not varied. Butterfly valve 64 is rotatable on laterally extending hinge 65 between closed position as seen in FIG. 6 and full open position as indicated by broken line 64'. See also in FIG. 7 butterfly control 180, to rotate it for air and fuel mix flow control. In closed position of the butterfly, ports 153 and 159 are downstream of the butterfly, and port 160 is upstream of it, as shown. Port 170 is normally plugged. Referring to FIG. 3, a throttle control cable end is attachable to a recess 181 in rotary control 180. In FIG. 7, torsion springs 182 and 183 urge the butterfly valve toward closed position, via hinge 65.

Air jets are carried by the body, and terminate within an enclosure 66 formed on a side of the body. A removable cover 67 on the enclosure protects the air jets. One such jet passes air to the passage 161 leading to ports 159 and 160, as referred to. In butterfly 64 position seen in FIG. 6, air is sucked from the venturi passage through port 160 and passes to port 159. Idle fuel enters at 153.

Figure 10:
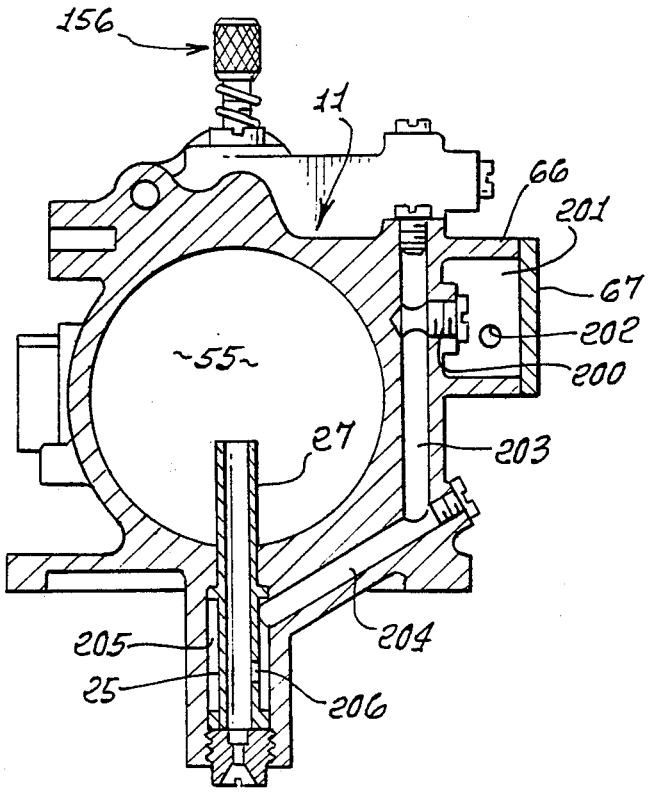
FIG. 10 is a section on lines 10—10 of FIG. 6.

Another such similar jet is shown in the form of an orifice plug 200 in FIG. 10. Air enters enclosed space 201 via a port 202, is metered through the jet 200 to passages 203 and 204, flows to plenum 205 about the base of jet tube 25, and is drawn by suction into fuel flowing in that tube as via ports 206 in the wall of the tube base, for pre-mixing with the fuel passing to the venturi.

Figure 9:
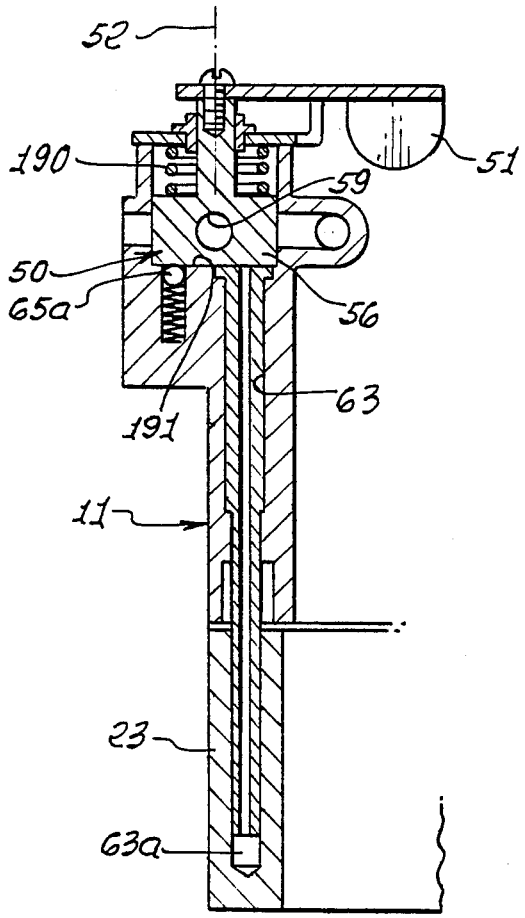
FIG. 9 is an elevation in section taken on lines 9—9 of FIG. 8.

In FIG. 9, fuel supply passage 63, as shown, extends downwardly to a lower level 63*a* in registration with the interior of the tank 23.

I claim:

1. In a carburetor as for a motorcycle engine, the combination with said engine comprising:

(a) a body forming an axial through passage for intake air, and a butterfly valve in said passage, (b) a venturi tube removably fitting axially endwise in said passage, the tube having an inner wall defining a venturi for passing the air, the tube having a side port, (c) a fuel jet tube carried by the body and projecting laterally through said side port into the venturi for jetting fuel into air passing through the venturi, (d) and an orifice plug removably carried by the body at one end of said tube, and removable to provide access to the fuel jet tube to enable lateral withdrawal of the fuel jet tube from the venturi tube and said port therein, (e) a starting carburetor mounted on the body and having a flow control member, and a handle for moving the starting carburetor flow control member between closed and open positions, (f) said handle presented upwardly for direct grasping by the hand of the motorcyclist, the body being attached to motorcycle engine structure.

2. The combination of claim 1 including axially interengageable stop shoulders carried by the venturi tube and the body to seat the venturi tube, axially endwise in said body.

3. The combination of claim 1 including a fuel float tank associated with said body and in communication with said fuel jet tube, and a removable plug carried by said tank and located in alignment with said orifice plug to enable access to that plug for effecting said removal thereof.

4. The combination of claim 3 including a fuel inlet fitting on the body and projecting exteriorly thereof for receiving the end of a fuel delivery line, said fitting forming a duct in communication with said tank, and swivel means mounting said fitting to the body to swivel relative to the body.

5. The combination of claim 1 including an auxiliary port into said passage, and air and fuel ports in and associated with the starting carburetor for gradually reducing air and fuel flow to said auxiliary port such that the fuel flow is cut off before the air flow is cut off, as the flow control member is rotated from open to closed position.

6. The combination of claim 5 wherein said flow control member comprises a rotatable element having air and fuel flow passages therein that are registrable with air and fuel passages in the body and at passage mouths, certain passage mouths enlarged relative to other passage mouths to effect said relationship of air and fuel cut offs.

7. In a carburetor for a motorcycle engine, the combination with said engine comprising:

(a) a body forming an axial through passage for intake air, and a butterfly valve in said passage, (b) a wall in said passage forming a venturi, (c) a main fuel jet carried by the body to jet fuel into said passage;

(d) a fuel float tank associated with the body and in communication with said fuel jet, (e) and a fuel inlet fitting on the body and projecting exteriorly thereof for receiving the end of a fuel delivery line, said fitting forming a duct in communication with said tank, (f) swivel means mounting said fitting to the body to swivel relative to the body, (g) and a starting carburetor having air and fuel mixture flow control means associated with the body and having a control handle presented generally upwardly for grasping by the hand of the motorcyclist, the body attached to the motorcycle intake manifold.

8. The combination of claim 7 wherein said fitting includes a sleeve and a nipple on the sleeve connectible to the fuel delivery line, and said swivel means includes a fastener threadably attached to the body, and forming a swivel bearing for said sleeve.

9. The combination of claim 8 including an auxiliary port into said passage, and air and fuel ports in and associated with the starting carburetor for gradually reducing air and fuel flow to said auxiliary port such that the fuel flow is cut off before air flow is cut off, as said flow control handle is rotated from open to closed positions.

10. In a carburetor for a motorcycle engine, the combination with said engine comprising:

(a) a body forming an axial through passage for intake air, and a butterfly valve in said passage, (b) a wall in said passage forming a venturi, (c) a main fuel jet carried by the body to jet fuel into said passage, (d) a fuel float tank associated with the body and in communication with said fuel jet, (e) and a fuel inlet fitting on the body and projecting exteriorly thereof for receiving the end of a fuel delivery line, said fitting forming a duct in communication with said tank, (f) and swivel means mounting said fitting to the body to swivel relative to the body, (g) said fitting including a sleeve and a nipple on the sleeve connectible to the fuel delivery line, and said swivel means includes a fastener threadably attached to the body, and forming a swivel bearing for said sleeve, (h) and including a starting carburetor mounted on the body and having a flow control member and a handle for rotating said member between closed and fully open positions, and an auxiliary port into said passage, and air and fuel porting in and associated with the starting carburetor for gradually reducing air and fuel flow to said auxiliary port such that the fuel flow is cut off before air flow is cut off, as the flow control member is rotated from open to closed positions, (i) the carburetor being attached to the side of a motorcycle engine intake manifold, the starting carburetor handle presented upwardly for direct grasping by the hand of the cyclist.

11. In a carburetor for a motorcycle engine, the combination with said engine comprising:

(a) a body forming an axial through passage for intake air, and a butterfly valve in said passage, (b) a wall in said passage forming a venturi, (c) a main fuel jet carried by the body to jet fuel into said passage, (d) a fuel float tank associated with the body and in communication with said fuel jet, (e) and a fuel inlet fitting on the body and projecting exteriorly thereof for receiving the end of a fuel delivery line, said fitting forming a duct in communication with said tank, (f) swivel means mounting said fitting to the body to swivel relative to the body, (g) and including two air jets carried by said body, and a removable cover on the body protecting said jets, one air jet passing air to one fuel port at the downstream side of the butterfly valve, for engine idle control, (h) and a starting carburetor having a fuel air mixture flow control member carried by the body, there being a handle for said member presented for manual grasping by the motorcyclist, said body attached to motorcycle engine structure, said handle movable for displacing said member between closed and open positions.

12. In a carburetor for a motorcycle engine, the combination with said engine comprising:

(a) a body forming an axial through passage for intake air, and a butterfly valve in said passage, (b) a wall in said passage forming a venturi, (c) a main fuel jet carried by the body to jet fuel into said passage, (d) a fuel float tank associated with the body and in communication with said fuel jet, (e) a starting carburetor mounted on the body and having an air and fuel mixture flow control member and a handle for rotating said member between closed and fully open positions, and an auxiliary port into said passage, (f) and air and fuel ports in and associated with starting carburetor for gradually reducing air and fuel flow to said auxiliary port such that the fuel flow is cut off before the air flow is cut off, as the flow control member is rotated from open to closed positions, (g) said handle presented upwardly for direct grasping by the hand of the motorcyclist, the carburetor body attached to the side of the motorcycle engine intake manifold.

13. The combination of claim 12 wherein said flow control member includes a rotatable element having air and fuel flow passages therein that are registrable with air and fuel passages in the body and at passage mouths, certain passage mouths enlarged relative to other passage mouths to effect said relationship of air and fuel cut offs.

14. The combination of claim 12 including auxiliary air and fuel passages in the body communicating with said axial through passage, via a port downstream of the venturi and butterfly valve.

15. The combination of claim 14 wherein said auxiliary air passage extends to an enclosure at the side of the carburetor body, and a removable cap on the enclosure.

16. In a carburetor for a motorcycle engine, the combination with said engine comprising:

(a) a body forming an axial through passage for intake air, and a butterfly valve in said passage, (b) a wall in said passage forming a venturi, (c) a main fuel jet carried by the body to jet fuel into said passage, (d) a fuel float tank associated with the body and in communication with said fuel jet, (e) a starting carburetor mounting on the body and having an air and fuel mixture flow control member and a handle for rotating the member between closed and fully open positions and an auxiliary port into said passage, (f) and air and fuel porting in and associated with the starting carburetor for gradually reducing air and fuel flow to said auxiliary port such that the fuel flow is cut off before the air flow is cut off, as the flow control member is rotated from open to closed positions, (g) said handle presented upwardly for direct grasping by the hand of the motorcyclist, when the carburetor body is attached to the side of the motorcycle engine intake manifold, (h) said member including a rotatable element having air and fuel flow passages therein that are registrable with air and fuel passages in the body and at passage mouths, certain passage mouths enlarged relative to other passage mouths to effect said relationship of air and fuel cut offs, (i) the carburetor body being attached to the side of a motorcycle engine intake manifold, with said handle presented upwardly for direct grasping by the hand of the cyclist.

* * * * *